US006583565B2

(12) United States Patent
Nishida et al.

(10) Patent No.: US 6,583,565 B2
(45) Date of Patent: Jun. 24, 2003

(54) HIGH PRESSURE DISCHARGE LAMP

(75) Inventors: Kazuhisa Nishida, Tokyo (JP); Yasuhiro Akiyama, Tokyo (JP)

(73) Assignee: NEC Microwave Tube, Ltd., Sagamihara (JP)

( * ) Notice: Subject to any disclaimer, the term of this patent is extended or adjusted under 35 U.S.C. 154(b) by 27 days.

(21) Appl. No.: 09/801,661

(22) Filed: Mar. 9, 2001

(65) Prior Publication Data

US 2001/0028220 A1 Oct. 11, 2001

(30) Foreign Application Priority Data

Mar. 10, 2000 (JP) ..... 2000-067609

(51) Int. Cl.[7] ..... H01J 17/16; H01J 61/30
(52) U.S. Cl. ..... 313/634; 313/623; 313/570
(58) Field of Search ..... 313/623, 634, 313/570

(56) References Cited

U.S. PATENT DOCUMENTS 6,181,064 B1 * 1/2001 Narita ..... 313/570

FOREIGN PATENT DOCUMENTS

| | | | |
|---|---|---|---|
| GB | 2000 637 A | 7/1978 | |
| JP | 56-26351 | 3/1981 | ..... H01J/61/88 |
| JP | 05-089848 | 4/1993 | |
| JP | 11-149899 | 6/1999 | ..... H01J/61/20 |
| JP | 11-297268 | 10/1999 | ..... H01J/61/20 |

* cited by examiner

*Primary Examiner*—Sandra O'Shea
*Assistant Examiner*—Pete Macchiarolo
(74) *Attorney, Agent, or Firm*—McGinn & Gibb, PLLC

(57) ABSTRACT

A high pressure discharge lamp includes: a quartz glass bulb having an expanded portion and sealing portions; conductive elements, and a pair of electrodes. The conductive elements are airtightly sealed at the sealing portions of the quartz glass bulb. Each electrode of the pair of electrodes is disposed so as to be opposite the other and each electrode is connected to one of the conductive elements. An angle $\theta_1$ between a tangent along the inner surface of the expanded portion at a position 0.5 mm away from an origin of one of the sealing portions along the length direction of each electrode and the direction of the length of each electrode is at least about 40°.

28 Claims, 2 Drawing Sheets

HIGH PRESSURE DISCHARGE LAMP

BACKGROUND OF THE INVENTION

1. Field of the Invention

The present invention relates to a high pressure discharge lamp. More specifically, the present invention relates to a high pressure discharge lamp which does not have problems such as a blowout of the bulb made of quartz glass or a leaking of a contained gas from the quartz glass bulb.

2. Description of Related Art

In general, a high pressure discharge lamp has a structure as shown in FIG. 3. In the high pressure discharge lamp shown in FIG. 3, each electrode of a pair of electrodes (i.e., an anode 3 and a cathode 4) is disposed so as to be opposite the other in a quartz glass bulb 2, which includes an expanded portion for luminescence 21 and sealing portions 22. The quartz glass bulb 2 is formed by welding the sealing portions 22. The anode 3 and the cathode 4 are joined by, for instance, welding with molybdenum foils 5 and 5'. Also, the sealing portions 22 of the quartz glass bulb 2 are airtightly sealed by, for example, welding with molybdenum foils 5 and 5'. A gas for assisting an electric discharge is contained in the expanded portion for luminescence 21 of the quartz glass bulb 2 which has been airtightly sealed.

The temperature inside such a high pressure discharge lamp 1 tends to be increased when the luminous efficacy of the lamp 1 is enhanced by increasing the pressure of a light emitting material or a gas contained in the lamp 1.

However, since each of the sealing portions is airtightly sealed by welding the two portions of the quartz glass, problems such as leaking, cracking, or even breaking at the welding portions may be caused when the internal pressure of the bulb 2 is increased.

Accordingly, one of the objectives of the present invention is to provide a high pressure discharge lamp which is capable of maintaining the airtightness even if the pressure of a light emitting material or a gas contained in the lamp is increased and to prevent such problems as leaking or a blowout of the quartz glass bulb.

The inventors of the present invention, after pursuing diligent studies to achieve the above-mentioned objectives, made observations of the angle between the quartz glass bulb and the direction along the length of an electrode in the vicinity of the sealing portion and have discovered that the internal pressure of the high pressure discharge lamp acts strongly in the direction of detachment of the welded portion of the quartz glass bulb when this angle is small, and that the internal pressure of the lamp, which acts in the direction detaching the welded portion of the quartz glass, becomes smaller as the angle increases. Accordingly, the airtightness of the high pressure discharge lamp may be maintained when the angle formed by the quartz glass bulb and the direction along the length of an electrode in the vicinity of the sealing portion is large and, hence, problems such as a leaking of the contained gas or a blowout of the bulb may be prevented.

SUMMARY OF THE INVENTION

The present invention provides a high pressure discharge lamp including: a quartz glass bulb having an expanded portion and sealing portions; conductive elements, which are airtightly sealed at the sealing portions of the quartz glass bulb; and a pair of electrodes, each electrode of the pair of electrodes being disposed so as to be opposite the other and each electrode being connected to one of the conductive elements, wherein an angle $\theta_1$ between a tangent along the inner surface of the expanded portion at a position 0.5 mm away from an origin of one of the sealing portions along the length of each electrode and the direction along the length of each electrode is at least about 40° (wherein the origin of one of the sealing portions is defined as a boundary point between the end of one of the sealing portions and an inner surface of the expanded portion; and the tangent along the inner surface of the expanded portion at a position 0.5 mm away from the origin is defined as a tangent which passes through a point of intersection defined by a straight line perpendicular to the direction along the length of each electrode, which passes through a point 0.5 mm away from the origin of one of the sealing portions toward the expanded portion along the length of each electrode, and the inner surface of the expanded portion and makes contact with the inner surface of the expanded portion).

In accordance with another aspect of the invention, the conductive elements are molybdenum foils.

In yet another aspect of the invention, an angle $\theta_2$ between a tangent along the inner surface of the expanded portion at an optional point between more than 0.5 mm and 1.5 mm from the origin of one of the sealing portions along the length of each electrode and the direction along the length of each electrode is at least about 45° (wherein the tangent along the inner surface of the expanded portion at an optional point between more than 0.5 mm and 1.5 mm from the origin is defined as a tangent which passes through a point of intersection defined by a straight line perpendicular to the direction along the length of each electrode, which passes through an optional point between more than 0.5 mm and 1.5 mm from the origin of one of the sealing portions toward the expanded portion along the length of each electrode, and the inner surface of the expanded portion and makes contact with the inner surface of the expanded portion).

In yet another aspect of the invention, an angle $\theta_3$ between a tangent along the inner surface of the expanded portion at an optional point between more than 1.5 mm and 3 mm from the origin of one of the sealing portions along the length of each electrode and the direction along the length of each electrode is at least about 50° (wherein the tangent along the inner surface of the expanded portion at an optional point between more than 1.5 mm and 3 mm from the origin is defined as a tangent which passes through a point of intersection defined by a straight line perpendicular to the direction along the length of each electrode, which passes through an optional point between more than 1.5 mm and 3 mm from the origin of one of the sealing portions toward the expanded portion along the length of each electrode, and the inner surface of the expanded portion and makes contact with the inner surface of the expanded portion).

In yet another aspect of the invention, the relationship among $\theta_1$, $\theta_2$ and $\theta_3$ is $\theta_1<\theta_2<\theta_3$.

In yet another aspect of the invention, $\theta_1$ is at least about 45°.

In yet another aspect of the invention, $\theta_2$ is at least about 60°.

In yet another aspect of the invention, $\theta_3$ is at least about 70°.

In yet another aspect of the invention, mercury vapor is contained in the high pressure discharge lamp in an amount between about 0.12 and 0.3 mg/mm$^3$.

In yet another aspect of the invention, a halogen gas is contained in the high pressure discharge lamp in an amount between about $10^{-8}$ and $10^{-2}$ $\mu$mol/mm$^3$.

In yet another aspect of the invention, an inert gas is contained in the high pressure discharge lamp at a pressure of about 6 kPa or greater.

In yet another aspect of the invention, the bulb wall loading in the high pressure discharge lamp is about 0.8 $W/mm^2$ or greater.

In yet another aspect of the invention, the pair of electrodes comprise tungsten containing potassium oxide.

In yet another aspect of the invention, the relationship between an internal pressure P (atm) of the high pressure discharge lamp and the angle $\theta_1$ is:

$$\theta_1 \geqq 0.25P+5 \text{(wherein } P \geqq 140\text{)}.$$

According to the present invention, it becomes possible to provide a high pressure discharge lamp which is capable of maintaining the airtightness even if the pressure of a light emitting material or a gas contained in the lamp is increased and to prevent such problems as a leaking or a blowout of the quartz glass bulb.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

An object of the present invention is to provide a high pressure discharge lamp in which the above-mentioned problems have been solved.

Another object of the present invention is to provide a high pressure discharge lamp which, even after being lit for a considerably long time, does not have problems such as a blowout of the bulb made of quartz glass and a leaking of the contained gas from the quartz glass bulb.

The invention summarized above and defined by the enumerated claims may be better understood by referring to the following detailed description, which should be read with reference to the accompanying drawings. This detailed description of a particular preferred embodiment, set out below to enable one to build and use one particular implementation of the invention, is not intended to limit the enumerated claims, but to serve as a particular example thereof.

Figure 1:
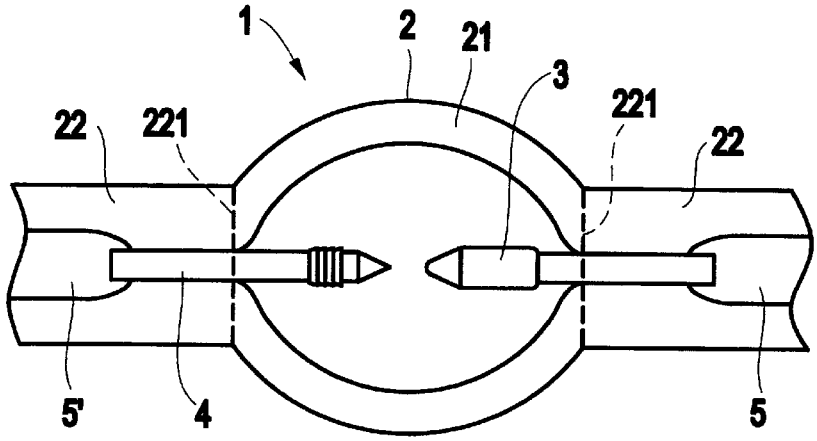
FIG. 1 is a diagram showing a schematic cross-sectional view of a high pressure discharge lamp according to an embodiment of the present invention.

FIG. 1 is a diagram showing a schematic cross-sectional view of a high pressure discharge lamp 1 according to an embodiment of the present invention. In FIG. 1, a high pressure discharge lamp 1 includes a quartz glass bulb 2, an anode 3, a cathode 4, and molybdenum foils 5 and 5'. The quartz glass bulb 2 has an expanded portion 21. The shape of the expanded portion 21 is not particularly limited and may be spherical or oval-spherical. The quartz glass bulb 2 may be formed by using a natural or synthetic quartz glass. Also, the quartz glass bulb 2 may be a single layer bulb formed as a one-piece unit or a two or more layer multi-layered bulb. The shape of the anode 3 and that of the cathode 4 may be the same or can be different. The distance between the anode 3 and the cathode 4 is not particularly limited. The anode 3 and the cathode 4 are joined to the molybdenum foils 5 and 5' by, for example, a welding means. The quartz glass bulb 2 is airtightly sealed with the molybdenum foils 5 and 5' at sealing portions 22. A gas for assisting a discharge, such as mercury vapor, is contained and sealed in the expanded portion 21.

It is essential, according to the present invention, that the angle $\theta_1$, which is an angle between a tangent along the inner surface of the expanded portion at a position 0.5 mm away from the origin of the sealing portion along the length of each electrode and the direction along the length of the electrode, be at least about 40°. This will be explained with reference to FIG. 2.

Figure 2:
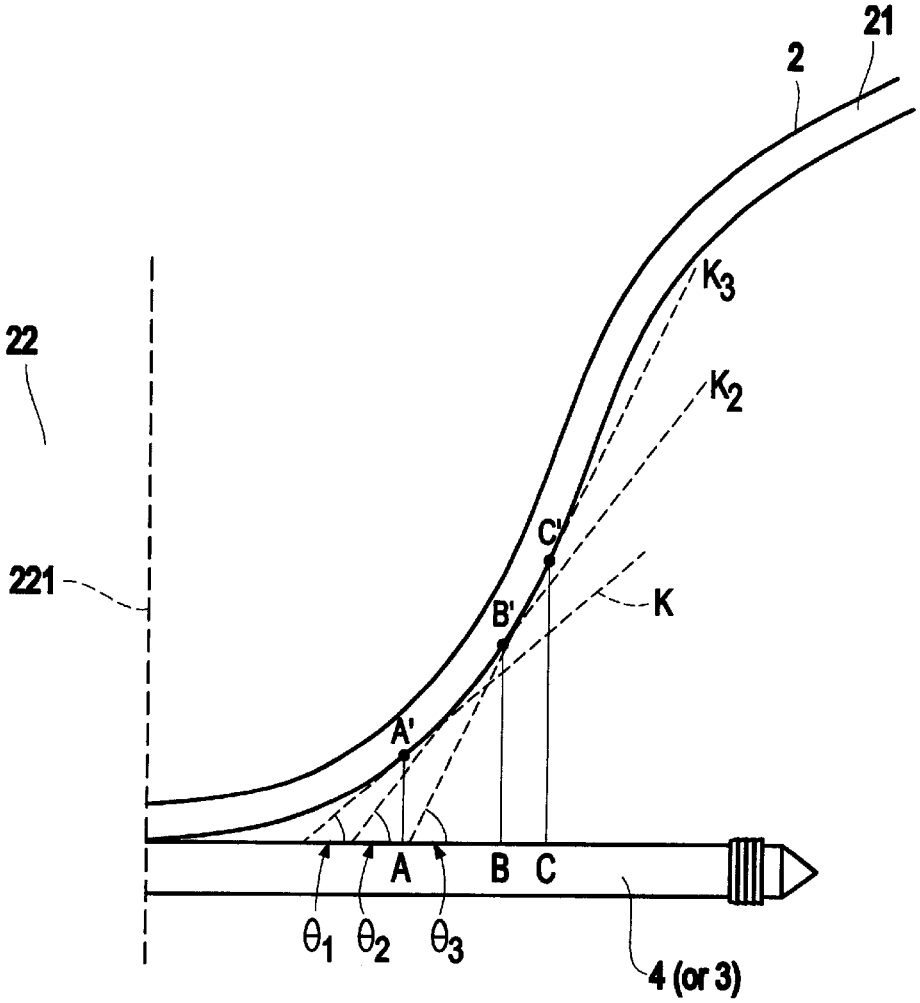
FIG. 2 is an enlarged schematic cross-sectional view for explaining the vicinity of an origin of a sealing portion of the high pressure discharge lamp according to the embodiment of the present invention.
Figure 3:
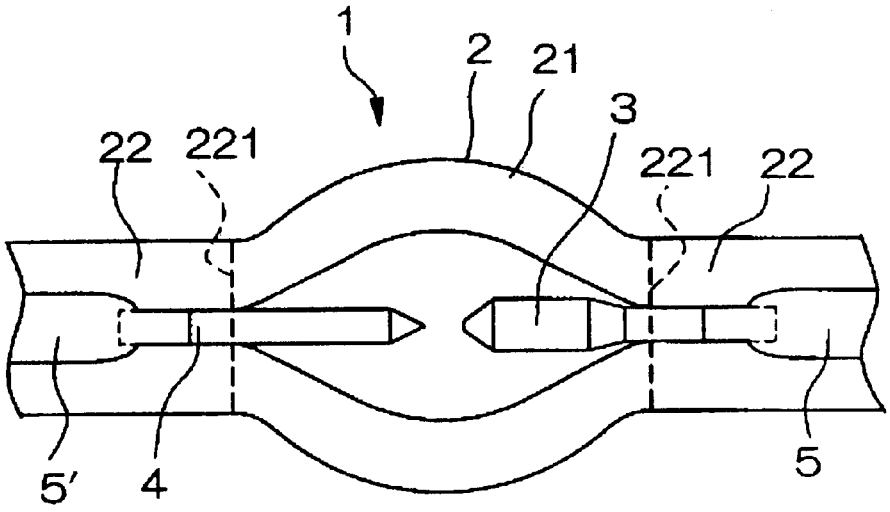
FIG. 3 is a diagram showing a schematic cross-sectional view of a conventional high pressure discharge lamp.

FIG. 2 is an enlarged schematic cross-sectional view showing the vicinity of the origin of the sealing portion of the high pressure discharge lamp 1. The dotted line 221 indicates an end of the sealing portion 22. In this specification, the term "the origin of the sealing portion" means a boundary point between the end of the sealing portion 22 and the inner surface of the expanded portion 21. As shown in FIG. 2, the quartz glass of the expanded portion 21 of the quartz glass bulb 2 starts separating away from the electrodes 3 and 4 at the origin of the sealing portion 22. In FIG. 2, the point A is defined as a point, located on the surface of the electrode 4 (or 3), 0.5 mm away from the origin of the sealing portion 22 along the length direction of the electrode 4. The line A–A' is a straight line which passes through the point A so as to be perpendicular to the direction of the length of the electrode 4. The tangent k is a straight line along the inner surface of the expanded portion 21 which makes contact with the inner surface of the expanded portion 21 at the point A'. Thus, the term "a tangent along the inner surface of the expanded portion" means a straight line along the length of an electrode which passes through a point of intersection formed by a straight line perpendicular to the direction along the length of the electrode, which passes through a point 0.5 mm away from the origin of the sealing portion toward the expanded portion 21 along the length of the electrode, and the inner surface of the expanded portion 21 and makes contact with the inner surface of the expanded portion 21 of the quartz glass bulb 2. The angle $\theta_1$ is defined as an angle formed by the above-mentioned tangent and the direction along the length of the electrode.

According to the present invention, the angle $\theta_1$ is preferably about 45° or larger, more preferably about 50° or larger, and most preferably about 55° or larger. If the angle $\theta_1$ is about 40° or larger, it becomes possible to prevent such problems as a blowout of the bulb made of quartz glass or a leaking of the contained gas from the quartz glass bulb during the operation of the high pressure discharge lamp.

Also, according to the present invention, an angle $\theta_2$ which is an angle between a tangent at an optional point between more than 0.5 mm and 1.5 mm from the origin of the sealing portion along the length of the electrode (i.e., the tangent line $K_2$ which passes through a point of intersection defined by a straight line (B–B') perpendicular to the direction along the length of the electrode), which passes through an optional point between more than 0.5 mm and 1.5 mm from the origin of the sealing portion toward the expanded portion 21 along the length of the electrode, and the inner surface of the expanded portion 21 and makes contact with the inner surface of the expanded portion of the quartz glass bulb 2 and the direction along the length of the electrode, is preferably about 45° or larger and more preferably about 60° or larger. If the angle $\theta_2$ is about 45° or larger, problems such as a blowout of the bulb made of quartz glass or a leaking of the contained gas from the quartz glass during the operation of the high pressure discharge lamp may be prevented in a more efficient manner. The same definition of $\theta_1$ is applied to $\theta_2$ except that "a point 0.5 mm away from the origin" is changed to "an optional point between more than 0.5 mm away from the origin."

Moreover, according to the present invention, an angle $\theta_3$, which is an angle between a tangent at an optional point between more than 1.5 mm and 3 mm from the origin of the sealing portion along the length of the electrode, i.e., the tangent $K_3$, which passes through a point of intersection defined by a straight line (C–C') perpendicular to the direction along the length of the electrode, is preferably about 50° or larger, and more preferably about 70° or larger. If the angle $\theta_3$ is about 50° or larger, problems such as a blowout of the bulb made of quartz glass or a leaking of the contained gas from the quartz glass bulb during the operation of the high pressure discharge lamp may be further prevented in a more efficient manner. The same definition of $\theta_1$ is applied to $\theta_3$ except that "a point 0.5 mm away from the origin" to changed to "an optional point between more than 1.5 mm and 3 mm away from the origin".

Further, according to the present invention, the relationship among $\theta_1$, $\theta_2$ and $\theta_3$ is preferably $\theta_1<\theta_2<\theta_3$. If the relationship is $\theta_1<\theta_2<\theta_3$, problems such of the bulb made of quartz glass or a leaking of the contained gas from the quartz glass bulb during the operation of the high pressure discharge lamp may be prevented more efficiently since the internal pressure of the high pressure discharge lamp, which acts in the direction of detachment of the welded portion of the quartz glass bulb, becomes smaller.

In addition, according to the present invention, it is preferable that mercury vapor be contained and sealed in the high pressure discharge lamp. The amount of mercury vapor is preferably between about 0.12 and 0.3 mg/mm$^3$ and more preferably between about 0.18 and 0.24 mg/mm$^3$. If the amount of mercury vapor is between about 0.12 and 0.3 mg/mm$^3$, it becomes possible to improve the luminous efficacy of the lamp and prevent such problems as leaking or a blowout during the operation of the high pressure discharge lamp.

Also, according to the present invention, it is preferable that a halogen gas is contained and sealed in the high pressure discharge lamp. The amount of the halogen gas is preferably between about $10^{-8}$ and $10^{-2}$ $\mu$mol/mm$^3$ and more preferably between about $10^{-6}$ and $10^{-4}$ $\mu$mol/mm$^3$. If the amount of the halogen gas is between about $10^{-8}$ and $10^{-2}$ $\mu$mol/mm$^3$, it becomes possible to improve the luminous efficacy of the lamp and prevent such problems as leaking or a blowout during the operation of the high pressure discharge lamp. Examples of the halogen gas include chlorine gas, bromine gas, and iodine gas, and these may be used in combination. For the case in which two or more halogen gases are used in combination, it is preferable that the total amount of the gases be between about $10^{-8}$ and $10^{-2}$ $\mu$mol/mm$^3$.

Moreover, according to the present invention, it is preferable that an inert gas is contained and sealed in the high pressure discharge lamp. The pressure of the inert gas is preferably about 6 kPa or greater, and more preferably between about 20 and 50 kPa. If the pressure of the inert gas is 6 kPa or greater, it becomes possible to improve the luminous efficacy of the lamp and prevent such problems as leaking or a blowout during the operation of the high pressure discharge lamp. Examples of the inert gas include helium gas, neon gas, argon gas, krypton gas, and xenon gas, and these may be used in combination. For the case in which two or more inert gases are used in combination, it is preferable that the total pressure of the gases be about 50 kPa or less.

Further, according to the present invention, the bulb wall loading in the high pressure discharge lamp is preferably about 0.8 W/mm$^2$ or greater, and more preferably in the range between about 1.2 and 1.8 W/mm$^2$. If the bulb wall loading is about 0.8 W/mm$^2$ or greater, the luminous efficacy of the high pressure discharge lamp may be enhanced and problems such as leaking or a blowout during the operation of the high pressure discharge lamp may be prevented.

According to the present invention, the materials used for an anode and a cathode are preferably tungsten, molybdenum, and tantalum. The use of tungsten is more preferable and that of tungsten containing potassium oxide is especially preferable. The amount of potassium oxide in tungsten is preferably about 30 ppm or less. If tungsten containing potassium oxide is used, the luminous efficacy of the high pressure discharge lamp may be enhanced and problems such as leaking or a blowout during the operation of the high pressure discharge lamp may be prevented.

According to the present invention, the effect of preventing problems such as leaking or a blowout during the operation of the high pressure discharge lamp is especially remarkable when the relationship between the internal pressure P (atm) and $\theta_1$ is $\theta_1 \geqq 0.25P+5$ (wherein $P \geqq 140$). That is, when conventional techniques are used, problems such as the leaking of a contained gas or the blowout of the bulb during the operation of the high pressure discharge lamp are frequently caused although the luminous efficacy may be improved by increasing the internal pressure of the lamp. The occurrence of these problems may be significantly decreased by using the above-defined angle of $\theta_1$ when the internal pressure of the lamp is as described above.

Figure 4:
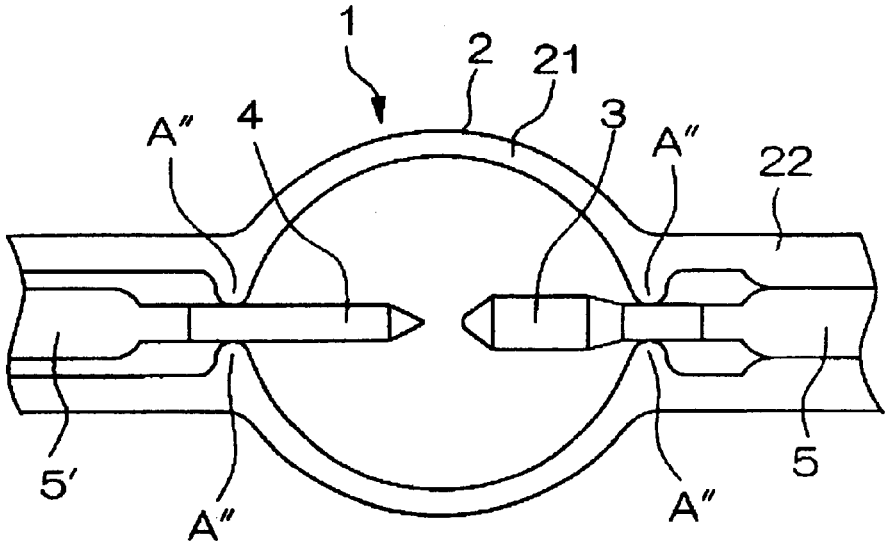
FIG. 4 is a diagram showing a schematic cross-sectional view of a high pressure discharge lamp according to another embodiment of the present invention which is manufactured by using a prefabricated quartz glass bulb.

As shown in FIG. 4, the high pressure discharge lamp according to another embodiment of the present invention may be manufactured by prefabricating, firstly, an extruding portion (i.e., a swelling or convex portion) by processing the quartz glass bulb 2 and then using a conventional method such as collapsing or natural fusing (melting). Alternatively, the high pressure discharge lamp according to yet another embodiment of the present invention may be produced by applying pressure along the length of an electrode when the sealing portion 22 is formed.

The characteristics of an embodiment of the high pressure discharge lamp according to the present invention are described as follows:

| | | |
|---|---|---|
| Electric power of the discharge lamp: | 120–200 | W |
| Voltage of the discharge lamp: | 50–100 | V |
| Distance between the electrodes: | 1.0–2.0 | mm |
| Luminous efficacy: | 40–70 | lm/W |
| Bulb wall loading: | 0.8–1.5 | W/mm$^2$ |
| Radiation wavelength: | 360–700 | nm |

The high pressure discharge lamp according to the present invention may be used in the same manner as a conventional high pressure discharge lamp. That is, when the high pressure discharge lamp of the present invention is connected to a power supply, a trigger voltage is applied to the cathode and the anode to start the discharge. In this manner, a desired brightness of the lamp may be obtained.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A high pressure discharge lamp, comprising:

a quartz glass bulb having an expanded portion and sealing portions;

conductive elements airtightly sealed at said sealing portions of said quartz glass bulb; and a pair of electrodes, each electrode of said pair of electrode electrodes being disposed so as to be opposite the other and each of said electrodes being connected to one of said conductive elements, wherein an angle $\theta_1$ between a tangent along the inner surface of said expanded portion at a position 0.5 mm away from an origin of one of said sealing portions along the length of each of said electrodes and the direction along the length of each of said electrodes is at least about 40°, and wherein an inert gas is contained in said high pressure discharge lamp at a pressure of at least 6 kPa.

2. A high pressure discharge lamp according to claim 1, wherein said conductive elements are molybdenum foils.

3. A high pressure discharge according to claim 1, wherein an angle $\theta_2$ between a tangent along the inner surface of said expanded portion at a point between more than 0.5 mm and 1.5 mm from the origin of one of said sealing portions along the length of each of said electrodes and the direction along the length of each of said electrodes is at least about 45°, and wherein said tangent along the inner surface of said expanded portion at an optional point between more than 0.5 mm and 1.5 mm from the origin is defined as a tangent which passes through a point of intersection defined by a straight line perpendicular to the direction along the length of each of said electrodes, which passes through an optional point between more than 0.5 mm and 1.5 mm from the origin of said one of said sealing portions toward said expanded portion along the length of each of said electrodes, and the inner surface of said expanded portion and makes contact with the inner surface of said expanded portion.

4. A high pressure discharge lamp according to claim 1, wherein an angle $\theta_3$ between a tangent along the inner surface of said expanded portion at a point between more than 1.5 mm and 3 mm from the origin of one of said length of each of said electrodes is at least about 50°, and wherein said tangent along the inner surface of said expanded portion at an optional point between more than 1.5 mm and 3 mm from the origin is defined as a tangent which passes through a point of intersection defined by a straight line perpendicular to the direction along the length of each of said electrodes, which passes through an optional point between more than 1.5 mm and 3 mm from the origin of said one of said sealing portions toward said expanded portion along the length of said electrodes, and the inner surface of said expanded portion and makes contact with the inner surface of said expanded portion.

5. A high pressure discharge lamp according to claim 4, wherein the relationship among $\theta_1$, $\theta_2$ and $\theta_3$ is $\theta_1<\theta_2<\theta_3$.

6. A high pressure discharge lamp according to claim 1, wherein $\theta_1$ is at least about 45°.

7. A high pressure discharge lamp according to claim 3, wherein $\theta_2$ is at least about 60°.

8. A high pressure discharge lamp according to claim 4, wherein $\theta_3$ is at least about 70°.

9. A high pressure discharge lamp according to claim 1, wherein mercury vapor is contained in the high pressure discharge lamp in an amount between about 0.12 and 0.3 $mg/mm^3$.

10. A high pressure discharge lamp according to claim 1, wherein a halogen gas is contained in the high pressure discharge lamp in an amount between about $10^{-8}$ and $10^{-2}$ $\mu mol/mm^3$.

11. A high pressure discharge lamp according to claim 1, wherein the bulb wall loading in the high pressure discharge lamp is about 0.8 $W/mm^2$ or greater.

12. A high pressure discharge lamp according to claim 1, wherein said pair of electrodes comprise tungsten containing potassium oxide.

13. A high pressure discharge lamp according to claim 1, wherein the relationship between an internal pressure P (atm) of the high pressure discharge lamp and the angle $\theta_1$ is:

$$\theta_1>0.25P+5, \text{ and}$$

wherein P>140.

14. A high pressure discharge lamp according to claim 3, wherein the relationship between an internal pressure P (atm) of the high pressure discharge lamp and the angle $\theta_1$ is:

$$\theta_1>0.25P+5, \text{ and}$$

wherein P>140.

15. A high pressure discharge lamp according to claim 4, wherein the relationship between an internal pressure P (atm) of the high pressure discharge lamp and the angle $\theta_1$ is:

$$\theta_1>0.25P+5, \text{ and}$$

wherein P>140.

16. A high pressure discharge lamp according to claim 3, wherein an angle $\theta_3$ between a tangent along the inner surface of said expanded portion at a point between more than 1.5 mm and 3 mm from the origin of one of said sealing portions along the length of each of said electrodes and the direction along the length of each of said electrodes is at least about 50°, and wherein said tangent along the inner surface of said expanded portion at said point between more than 1.5 mm and 3 mm from the origin is defined as a tangent which passes through a point of intersection defined by a straight line perpendicular to the direction along the length of each of said electrodes, which passes through said point between more than 1.5 mm and 3 mm from the origin of said one of said sealing portions toward said expanded portion along the length of each of said electrodes, and the inner surface of said expanded portion and makes contact with the inner surface of said expanded portion.

17. A high pressure discharge lamp according to claim 16, wherein the relationship among $\theta_1$, $\theta_2$ and $\theta_3$ is $\theta_1<\theta_2<\theta_3$.

18. A high pressure discharge lamp according to claim 16, wherein the relationship between an internal pressure P(atm) of the high pressure discharge lamp and the angle $\theta_1$ is:

$$\theta_1 \geqq 0.25P+5, \text{ and}$$

$$\text{wherein } P \geqq 140.$$

19. The high pressure discharge lamp according to claim 1, wherein said angle $\theta_1$ is at least 45°.

20. The high pressure discharge lamp according to claim 1, wherein said angle $\theta_1$ is at least 50°.

21. The high pressure discharge lamp according to claim 1, wherein said angle $\theta_1$ is at least 55°.

22. A high pressure discharge lamp, comprising:

a glass bulb having an expanded portion and sealing portions;

conductive elements sealed at said sealing portions of said glass bulb; and a pair of electrodes disposed opposite the other and each electrode being connected to one of said conductive elements, wherein an angle $\theta_1$ between a tangent along the inner surface of said expanded portion at a position away from an origin of one of said sealing portions along the length of each of said electrodes and the direction along the length of each of said electrodes is at least about 40°, and wherein an inert gas is contained in said high pressure discharge lamp at a pressure of at least 6 kPa.

23. The high pressure discharge lamp according to claim 22, wherein said conductive elements comprise a first molybdenum foil and a second molybdenum foil.

24. The high pressure discharge lamp according to claim 23, wherein a first welding portion is formed between said electrode of said pair of electrodes and said first molybdenum foil, and wherein a second welding portion is formed between said electrode of said pair of electrodes and said second molybdenum foil.

25. The high pressure discharge lamp according to claim 22, wherein said position is about 0.5 mm away from said one of said sealing portions.

26. The high pressure discharge lamp according to claim 24, wherein a third welding portion is formed between said first molybdenum foil and a first portion of said sealing portions, and wherein a fourth welding portion is formed between said second molybdenum foil and a second portion of said sealing portions.

27. The high pressure discharge lamp according to claim 22, wherein said glass bulb contains a halogen gas and said inert gas.

28. The high pressure discharge lamp according to claim 22, wherein said glass bulb contains a gas with a total pressure of no more than about 50 kPa.

* * * * *